US006373036B2

(12) United States Patent
Suzuki

(10) Patent No.: US 6,373,036 B2
(45) Date of Patent: Apr. 16, 2002

(54) INDUCTION HEATING APPARATUS HAVING PLURALITY OF COILS

(75) Inventor: Hitoshi Suzuki, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/899,024

(22) Filed: Jul. 6, 2001

(30) Foreign Application Priority Data

Jul. 31, 2000 (JP) ..... 2000-231025

(51) Int. Cl.[7] ..... H05B 6/06; H05B 6/40

(52) U.S. Cl. ..... 219/619; 219/662; 219/671; 219/672; 219/670; 399/330; 399/336

(58) Field of Search ..... 219/619, 655, 219/656, 661, 662, 668, 669, 671, 672, 670, 674; 399/320, 328, 330, 335, 336

(56) References Cited

U.S. PATENT DOCUMENTS 3,762,912 A * 10/1973 Jacquerie et al. ..... 219/671
5,304,767 A * 4/1994 McGaffigan et al. ..... 219/674
5,464,964 A 11/1995 Okuda et al. ..... 219/216
5,534,987 A 7/1996 Ohtsuka et al. ..... 355/203
5,747,774 A 5/1998 Suzuki et al. ..... 219/216
5,994,671 A 11/1999 Suzuki et al. ..... 219/216
6,188,054 B1 * 2/2001 Ohta ..... 219/619
6,300,608 B2 * 10/2001 Inoh ..... 219/672

FOREIGN PATENT DOCUMENTS

JP 8-16006 1/1996

* cited by examiner

*Primary Examiner*—Philip H. Leung
(74) *Attorney, Agent, or Firm*—Fitzpatrick, Cella, Harper & Scinto

(57) ABSTRACT

An induction heating apparatus used as a fixing apparatus of a copying machine, a printer, and the like includes a first coil for generating a magnetic field to induce an eddy current in a heating member, a second coil for cancelling the magnetic field generated by the first coil, and a third coil connected to the second coil and wound in a direction opposite from the winding direction of the second coil. The induction heating apparatus permits an efficient use of power.

6 Claims, 6 Drawing Sheets

INDUCTION HEATING APPARATUS HAVING PLURALITY OF COILS

BACKGROUND OF THE INVENTION

1. Field of the Invention

The present invention relates to an induction heating apparatus effectively used as a fixing apparatus of an image forming apparatus such as a copying machine or a printer.

2. Description of the Related Art

In an electromagnetic induction heating apparatus, a magnetic field is applied to a conductive member (electromagnetic induction heating material, induction magnetic material, magnetic-field absorbing material) which is fixed or is movable, and a material to be heated is heated by heat generated by eddy currents induced in the conductive member. For example, the heating apparatus is effective as image heating-fixing apparatuses in electrophotographic, electrostatic recording, and magnetic recording image forming apparatuses in which a recording material (material to be heated) having an unfixed toner image thereon is heated, and the unfixed toner image is thereby heated and fixedaas a permanently fixed image.

In a general type of heating apparatus, when materials to be heated (small materials), which have a width smaller than that of materials (large materials) of the maximum possible width to be passed through the apparatus, are successively passed therethrough and are subjected to heating, since heat is not consumed to heat the materials in a paper nonpassing region of a material heating section of the apparatus, that is, in a portion of a paper feeding region for large materials except for a paper feeding region for small materials, the temperature in the portion rises above the temperature in the paper feeding region, and a so-called "paper nonpassing region overheating phenomenon" occurs, that is, the temperature excessively rises above the allowable temperature.

As a technique of preventing such an overheating phenomenon, division and selective control is exerted on the magnetic-field generating means in the above-described electromagnetic induction heating apparatus, as disclosed in, for example, Japanese Patent Application Laid-Open No. 8-16006.

In this control, a magnetic-field generating means having a length corresponding to the maximum paper feeding width of a material to be heated is composed of several units divided in a direction crossing (intersecting) the paper passing direction, that is, the feeding direction of the material, and the units are selectively controlled to generate a magnetic field according to the width of a material to be heated. In a case in which a large material having a width corresponding to the maximum paper feeding width is used in the apparatus, all the units of the magnetic-field generating means are caused to generate heat so that a region of a conductive member corresponding to the maximum paper feeding width generates heat in accordance with the large material. In a case in which a small material having a width smaller than the maximum paper feeding width is used, some units of the magnetic-field generating means corresponding to a passing region for the small material are caused to generate a magnetic field, and the other parts corresponding to a paper nonpassing region are controlled so as not to generate a magnetic field. Consequently, only a region of the conductive member corresponding to the paper passing region for the small material generates heat, thereby heating the small material without causing the paper nonpassing region overheating phenomenon.

FIG. 8 shows an example of the control method. Referring to FIG. 8, the first to third divided exciting coil units A, B, and C serving as divided magnetic-field generating means include coils (exciting coils) 20*a*, 20*b*, and 20*c* and magnetic cores (exciting iron cores) 21*a*, 21*b*, and 21*c*, respectively. A fixed or movable conductive member performs electromagnetic induction heating due to the actions of magnetic fields generated by the first to third divided exciting coil units A, B, and C, and a material to be heated is conveyed into a material heating section while being in direct or indirect contact with the conductive member and is heated by the heat from the conductive member. In FIG. 8, the conductive member and the material to be heated are not shown.

The first to third divided exciting coil units A, B, and C are arranged in series in a direction crossing (intersecting) the feeding direction of a material to be heated. Line O—O represents a reference line of paper passing for the material to be heated. P1, P2, and P3 represents the paper passing widths relative to the reference line O—O in which materials to be heated of three sizes, namely, large, medium-sized, and small materials, are passed. The paper passing widths P1, P2, and P3 have a relationship P1>P2>P3.

The sum of the lengths of the first to third divided exciting coil units A, B, and C substantially corresponds to the large paper passing width (maximum paper passing width) P1, the sum of the lengths of the first and second divided exciting coil units A and B substantially corresponds to the medium-sized paper passing width P2, and the length of the first divided exciting coil unit A substantially corresponds to the small paper feeding width P3.

The coils 20*a*, 20*b*, and 20*c* of the first to third divided exciting coil units A, B, and C are independently and selectively energized according to the width of a material to be passed therethrough.

That is, in a case in which a large material is passed, the coils 20*a*, 20*b*, and 20*c* of the first to third divided exciting coil units A, B, and C are energized corresponding to the large paper feeding width P1, and the conductive member generates heat in the large paper feeding width P1 so as to heat the large material.

In a case in which a medium-sized material is passed, the coils 20*a* and 20*b* of the first and second divided exciting coil units A and B are energized corresponding to the medium-sized paper passing width P2, and the conductive member generates heat in the mediums-sized paper passing width P2 so as to heat the medium-sized material.

In this case, the current to be applied to the coil 20*c* of the third divided exciting coil unit C corresponding to the paper nonpassing region is controlled (the supply of power is cut off or the amount of power to be supplied is reduced) so that the portion of the conductive member corresponding to the paper nonpassing region does not generate heat.

In a case in which a small material is passed, the coil 20*a* of the first divided exciting coil unit A is energized corresponding to the small paper passing width P3, and the conductive member generates heat in the small paper passing width P3 so as to heat the small material.

In this case, the currents to be applied to the coils 20*b* and 20*c* of the second and third divided exciting coil units B and C corresponding to the paper nonpassing region are controlled so that the conductive member does not generate heat in the paper nonpassing region.

The above-described control makes it possible to prevent a paper nonpassing region overheating phenomenon when medium-sized or small recording materials are passed.

SUMMARY OF THE INVENTION

The present invention has been made in view of the above problems, and an object of the present invention is to provide an improved electromagnetic induction heating apparatus in which efficiency is improved by reusing demagnetized energy to heat a material in order to prevent overheating in a paper nonpassing region, and in which overheating can be prevented with simple means.

Another object of the present invention is to provide an induction heating apparatus which provides a high power consumption efficiency.

In order to achieve the above objects, according to an aspect of the present invention, there is provided an induction heating apparatus including a heating member, a first coil for generating a magnetic field so as to induce an eddy current in the heating member, a second coil for cancelling the magnetic field generated by the first coil; and a third coil connected to the second coil and wound in a direction opposite from the winding direction of the second coil.

Further objects, features, and advantages of the present invention will become apparent from the following description of the preferred embodiments with reference to the attached drawings.

DESCRIPTION OF THE PREFERRED EMBODIMENTS

First Embodiment (1) Example of Image Forming Apparatus

Figure 1:
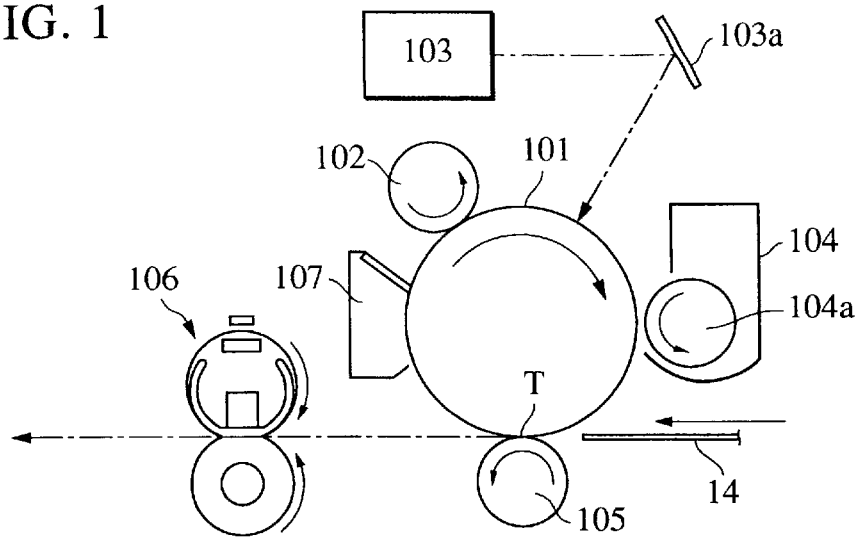
FIG. 1 is a general view showing the configuration of an image forming apparatus having an induction heating apparatus (image heating-fixing apparatus) according to a first embodiment of the present invention.

FIG. 1 is a schematic structural view of an image forming apparatus including an induction heating apparatus according to a first embodiment of the present invention. The image forming apparatus is a laser beam printer of an image transfer electrophotographic process type.

An electrophotographic photoconductive drum 101 serving as the image bearing member is rotationally driven at a predetermined peripheral velocity in a clockwise direction shown by the arrow in FIG. 1.

A conductive and elastic charging roller 102 serving as the charging means is in pressed contact with the photoconductive drum 101 with a predetermined pressing force so that it is driven by the rotation of the photoconductive drum 101 or is rotationally driven. By applying a predetermined charging bias from a power supply section (not shown) to the charging roller 102, the peripheral surface of the rotating photoconductive drum 101 is uniformly subjected to contact charging with a predetermined polarity and a predetermined potential.

An exposure device 103 serving as the information writing means is a laser scanner. The exposure device 103 outputs laser light modulated according to time-series electric digital image signals corresponding to image information, and thereby scan-exposes the uniformly charged surface of the rotating photoconductive drum 101 via a reflecting mirror 103*a*, whereby an electrostatic latent image corresponding to a scan-exposure pattern is formed on the surface of the photoconductive drum 101.

A developing device 104 develops the electrostatic latent image formed on the photoconductive drum 101 into a toner image. A predetermined developing bias voltage is applied from the power supply section (not shown) to a developing roller 104.

A conductive and elastic transfer roller 105 serving as the transfer means is in pressed contact with the photoconductive drum 101 with a predetermined pressing force so as to form a transfer nip portion T. Transfer materials 14 serving as the recording materials are supplied from a sheet supply section (not shown) at a predetermined control timing and are passed through the transfer nip portion T, and toner images on the surface of the photoconductive drum 101 are sequentially transferred onto the surfaces of the transfer materials 14. An appropriate bias voltage having a polarity opposite from the charging polarity of toner is applied from the power supply section (not shown) to the transfer roller 105 at a predetermined control timing.

A heating apparatus (image heating-fixing apparatus) 106 heats and fixes an unfixed toner image. Transfer materials 14 passed through the transfer nip portion T are sequentially separated from the surface of the photoconductive drum 101 and are conveyed into the heating apparatus 106, and toner images on the transfer materials 14 are fixed by heating and pressing. The transfer materials 14 passed through the heating apparatus 106 are discharged as image bearing materials (copies or prints). The heating apparatus 106 is of an electromagnetic induction heating type according to the present invention, and will be described in detail later.

A photoconductive-drum-surface cleaning device 107 cleans the surface of the photoconductive drum 101, from which a transfer material has been separated, of contaminants, such as residual toner and paper dust, remaining thereon. The surface of the photoconductive drum 101 cleaned by the cleaning device 107 is repeatedly used for image formation.

(2) Heating Apparatus 106 a) Overall Configuration of the Apparatus

Figure 2:
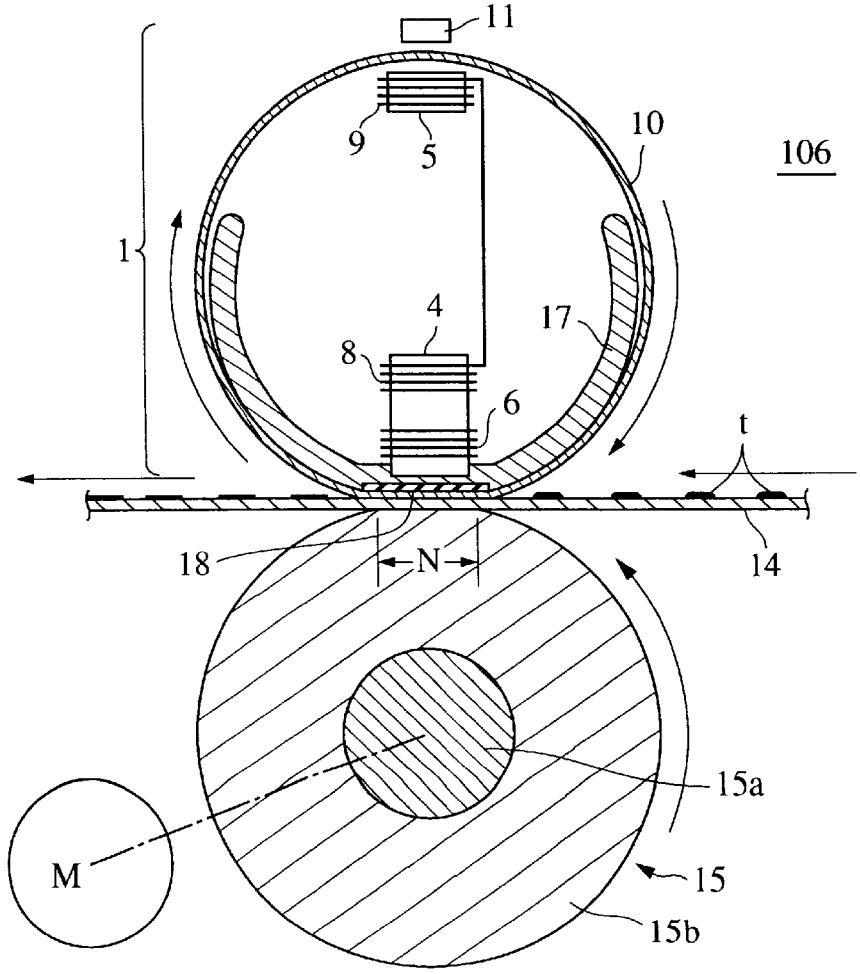
FIG. 2 is a transverse sectional view of the induction heating apparatus of the first embodiment.
Figure 3:
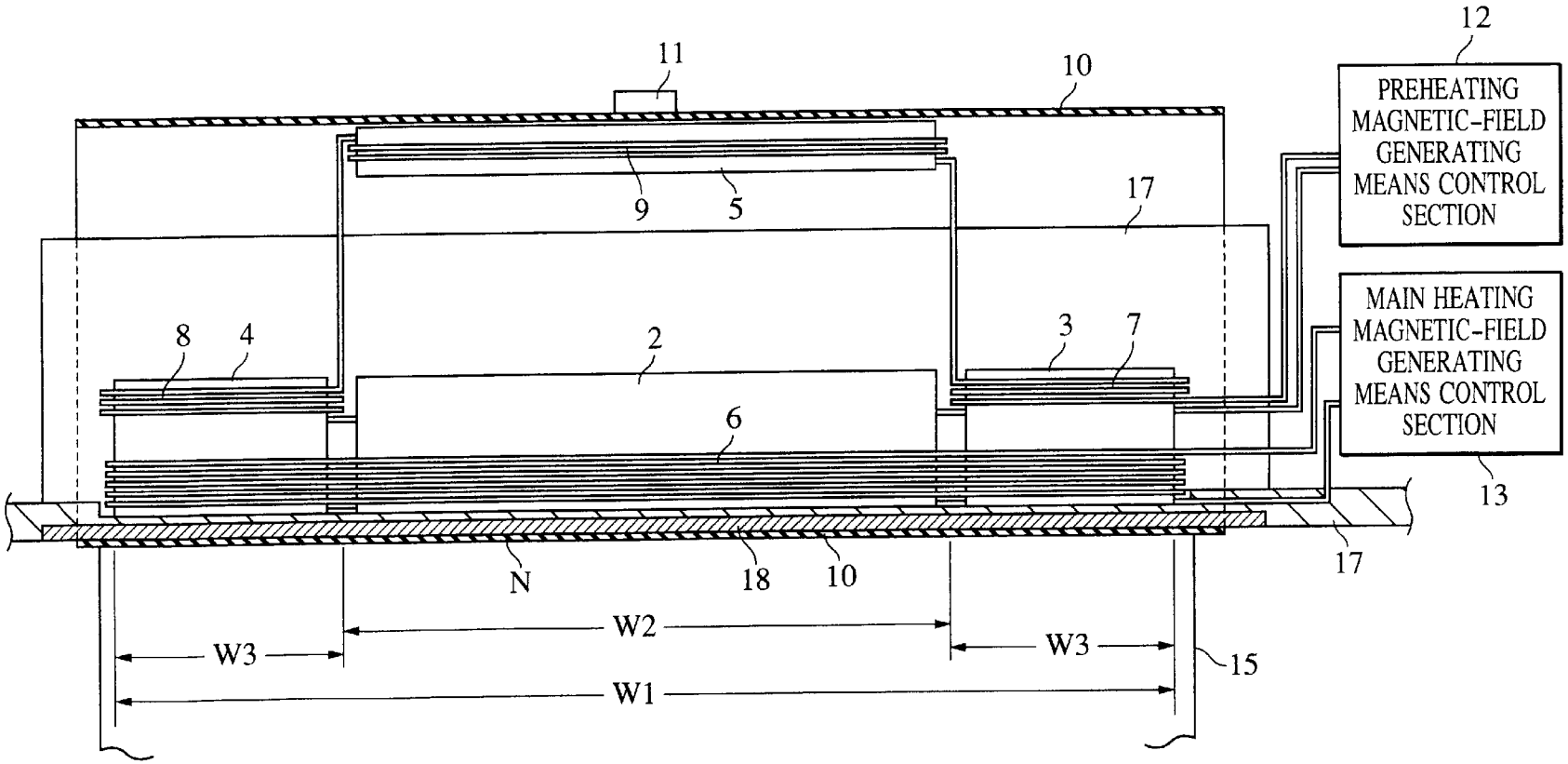
FIG. 3 is a longitudinal sectional view of the induction heating apparatus.

FIGS. 2 and 3 are a transverse sectional view and a longitudinal sectional view, respectively, of the heating apparatus 106.

A heating assembly 1 comprises a stay member 17 shaped like a trough having a substantially semi-arc-shaped cross section, magnetic-field generating devices 2 to 9 extending inside the stay member 17 in the longitudinal direction, a sliding member 18 extending on the outer lower surface of the stay member 17 in the longitudinal direction, a cylindrical fixing film 10 serving as the conductive member which is loosely fitted on the stay member 17 so as to generate heat by electromagnetic induction, and the like.

A pressure roller 15 serving as the pressing means is composed of a core bar 15*a*, and a heat-resistant elastic layer 15*b* made of silicon rubber, fluororubber, fluorine resin, or the like, and molded in the shape of a roller concentrically with the core bar 15*a* so as to cover the core bar 15*a*. Both ends of the core bar 15*a* are rotatably held between chassis side plates (not shown) of the apparatus.

The above-described heating assembly 1 is placed on the upper side of the pressure roller 15 and opposed thereto with the sliding member 18 facing down, and is pressed against the pressure roller 15 by an urging means (not shown) with a predetermined pressing force. The heat-resistant elastic layer 15*b* of the pressure roller 15 is deformed due to its elasticity, and the fixing film 10 is clamped between the sliding member 18 and the pressure roller 15, thereby forming a fixing nip portion N having a predetermined width serving as the material heating section.

The pressure roller 15 is rotated at a predetermined peripheral velocity in a counterclockwise direction shown by the arrow in FIG. 2 by a driving system M. With the rotation of the pressure roller 15, a rotational force acts on the fixing film 10 in the heating assembly 1 due to the pressed frictional force between the pressure roller 15 and the outer surface of the fixing film 10 at the fixing nip portion N, and the fixing film 10 is driven around the stay member 17 in the clockwise direction shown by the arrow while the inner surface thereof slides in close contact with the sliding member 18 at the fixing nip portion N. In order for the fixing film 10 to rotate more smoothly, a heat-resistant grease, such as a fluorine grease, may be applied as a lubricant between the sliding member 18 and the inner surface of the fixing film 10 at the fixing nip portion N.

The stay member 17 of the heating assembly 1 is a heat-resistant, heat-insulating, and rigid member molded from, for example, a liquid crystal polymer phenol resin. On the outer lower side of the stay member 17, an elongated spot-faced portion shaped like a shallow groove extends in the longitudinal direction thereof. The sliding member 18 is supported on the stay member 17 by being fitted in the spot-faced portion. The sliding member 18 is made of a heat-resistant slippery material having a low frictional resistance to the inner surface of the fixing film 10.

Figure 5:
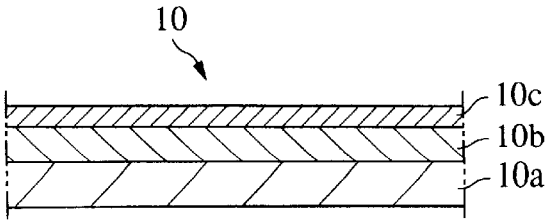
FIG. 5 is a structural view showing the layers of a fixing film for generating heat by electromagnetic induction.
Figure 6:
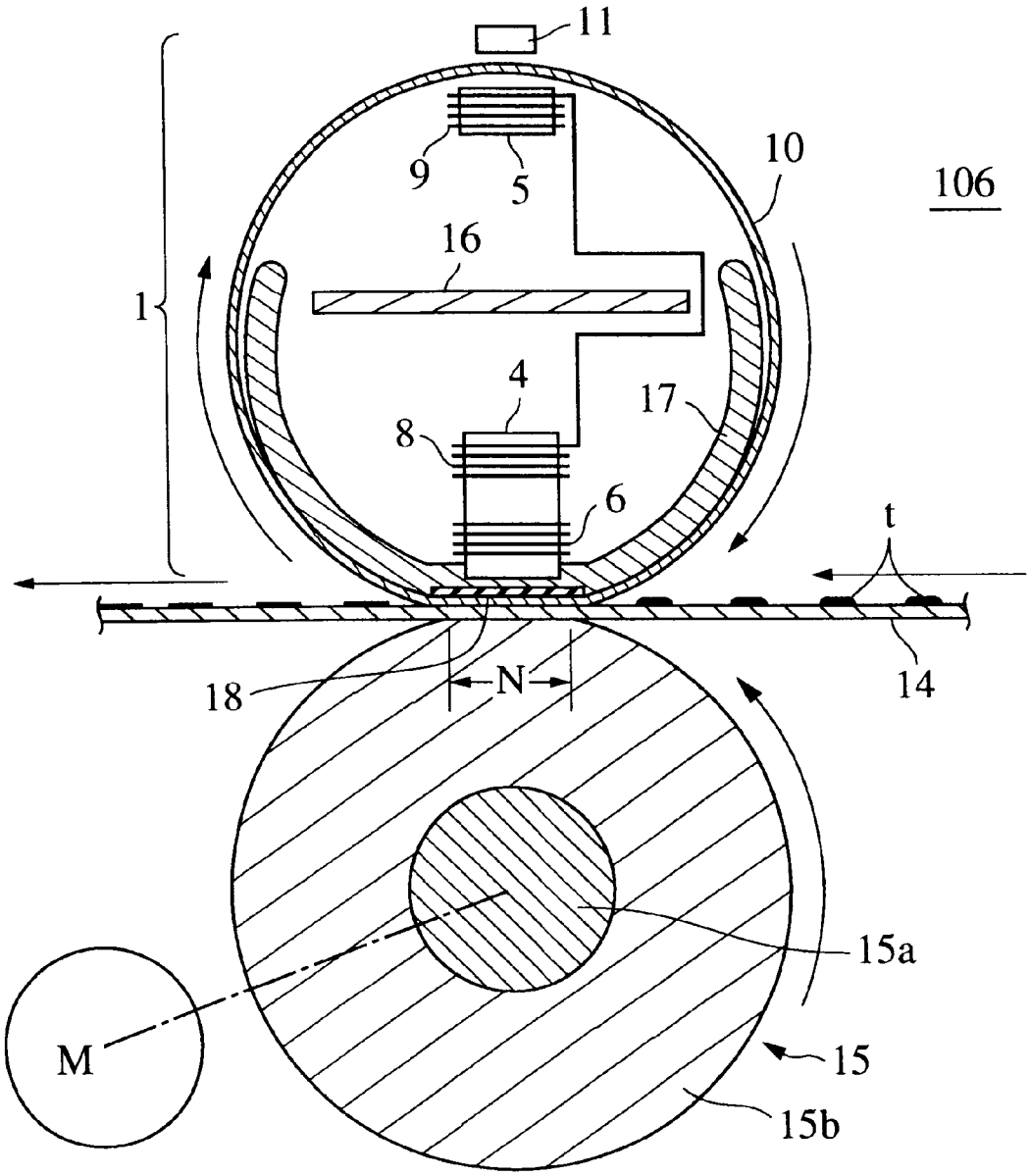
FIG. 6 is a transverse sectional view of an induction heating apparatus (image heating-fixing apparatus) according to a second embodiment of the present invention.
Figure 7:
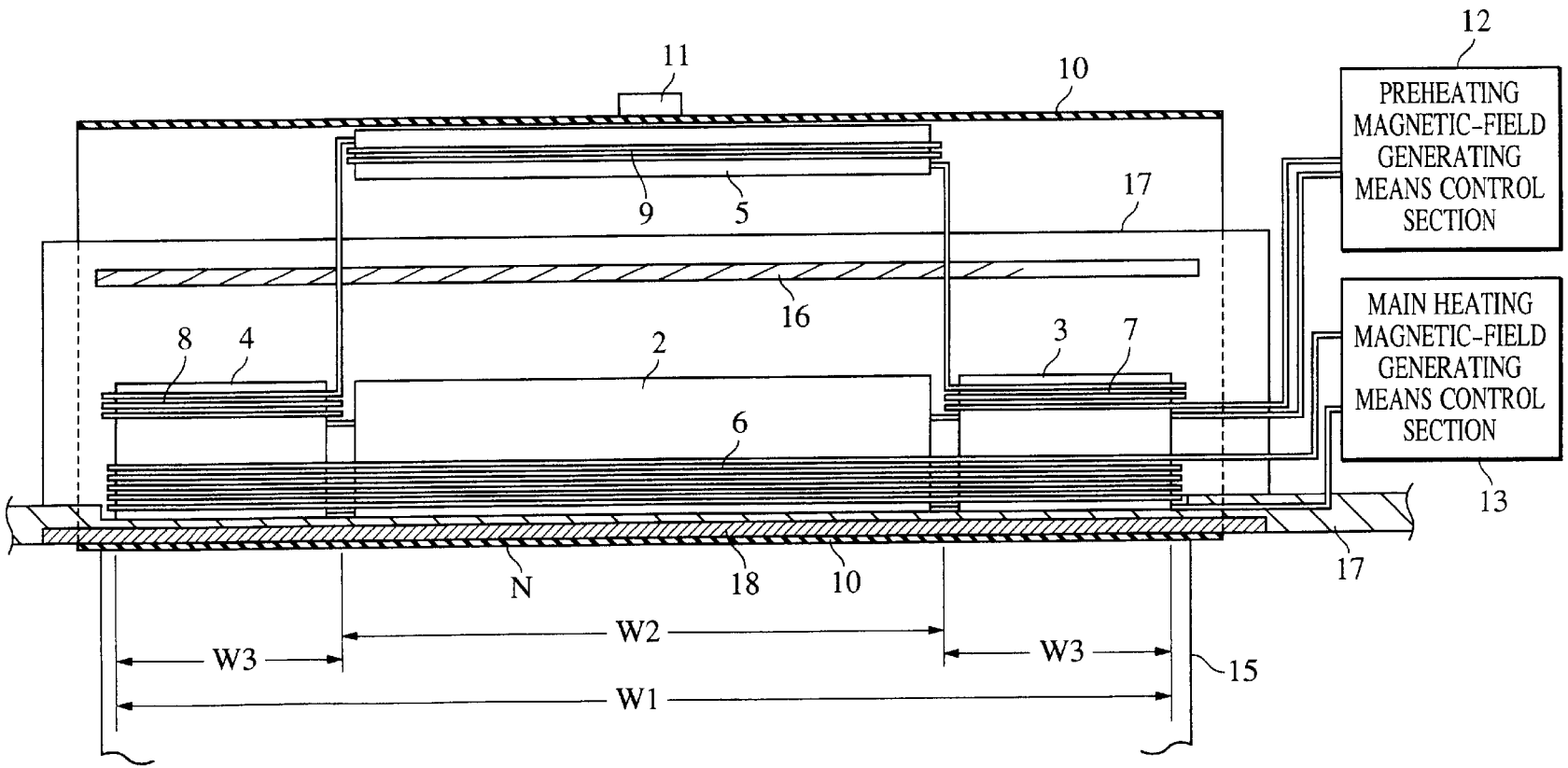
FIG. 7 is a longitudinal sectional view of the induction heating apparatus.
Figure 8:
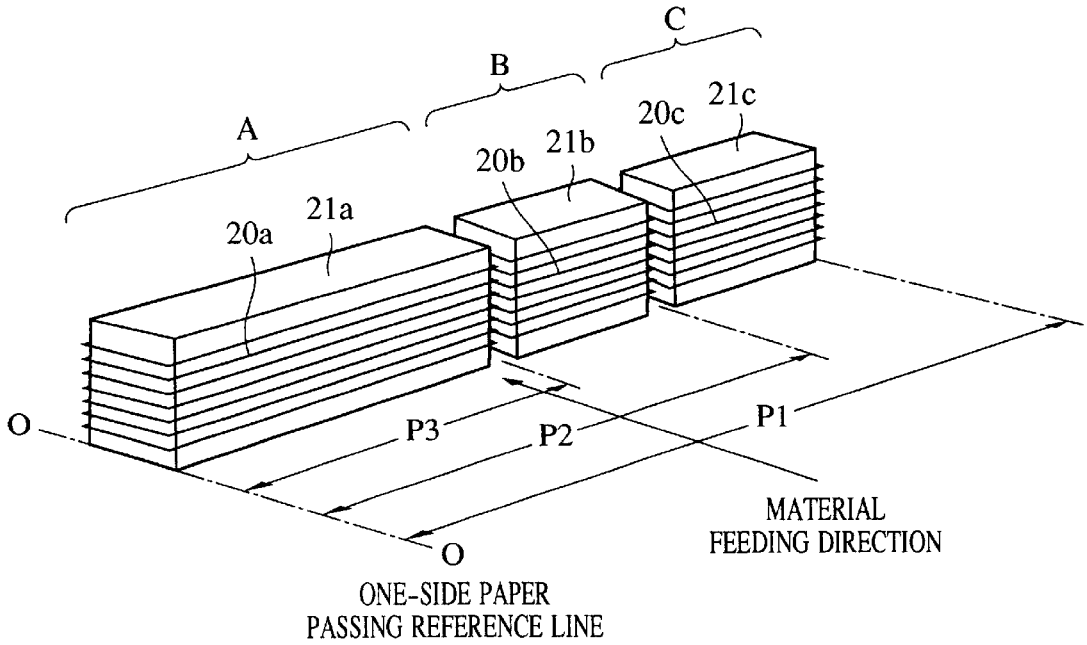
FIG. 8 is an explanatory view of a conventional electromagnetic induction heating apparatus.

In this embodiment, as shown in FIG. 5 as a structural view, the cylindrical fixing film 10 serving as the conductive member for generating heat by electromagnetic induction is composed of three layers, namely, a base layer 10*a* having a thickness of 10 $\mu$m to 100 $\mu$m and made of a heat-resistant resin, such as polyimide, polyimidoamide, PEEK, PES, PPS, PES, PTFE, or FEP, a conductive layer 10*b* formed on the outer periphery (on the side to be in pressed contact with a material to be heated) of the base layer 10*a*, having a thickness of 1 $\mu$m to 100 $\mu$m, and made of an iron or cobalt layer or a metal layer of copper, chrome, or the like formed by plating, and a releasing layer 10*c* formed as the outermost layer (surface layer) on the free surface of the conductive layer 10*b* and made of a heat-resistant resin having a great toner releasing ability, such as PFA, PTFE, FEP, or a silicon resin, or a combination of the resins. While the base layer 10*a* and the conductive layer 10*b* are separate in this embodiment, the base layer 10*a* may also function as a conductive layer.

The conductive layer 10*b* of the fixing film 10 is caused to perform electromagnetic induction heating by a magnetic field generated by the application of an alternating current from an exciting circuit (not shown) to the magnetic-field generating devices 2 to 9, which will be described later.

In such a state in which the fixing film 10 is rotated with the rotation of the pressure roller 15, the current is applied from the exciting circuit to the magnetic-field generating devices 2 to 9, and the conductive layer 10*b* of the fixing film 10 generates heat, a transfer material 14 serving as the material to be heated is conveyed into the fixing nip portion N and is passed therethrough in close contact with the surface of the fixing film 10, the heat of the fixing film 10 generated by electromagnetic induction is applied to the transfer material 14, and unfixed toner images "t" on the transfer material 14 are heated and fixed. The transfer material 14 passed through the fixing nip portion N is separated from the surface of the fixing film 10, and is conveyed further.

A temperature detecting element 11 detects the temperature of the fixing film 10, and feeds back information about the detected temperature to a control circuit (not shown). The control circuit controls the supply of power from the exciting circuit to the magnetic-field generating devices 2 to 9 according to the input detected temperature information so that the temperature of the fixing nip portion N is adjusted to a predetermined fixing temperature.

b) Magnetic-Field Generating Devices 2 to 9

The magnetic-field generating devices 2 to 9 include a main core (magnetic core, exciting iron core) 2, auxiliary cores 3 and 4, a preheating core 5, a main heating coil 6, auxiliary coils 7 and 8, and an auxiliary preheating coil 9.

The main core 2 is placed on the longitudinal center of the inner bottom surface of the stay member 17. The auxiliary cores 3 and 4 are arranged on both sides of the main core 2 in the longitudinal direction on the inner bottom surface of the stay member 17 so as to be connected in series with the main core 2. The three cores 2, 3, and 4 arranged in series are placed corresponding to the fixing nip portion N serving as the material heating section.

The main heating coil 6 is formed around the main core 2 and the auxiliary cores 3 and 4 arranged in series. The main core 2, the auxiliary cores 3 and 4, and the main heating coil 6 constitute a main heating magnetic-field generating means. A main heating magnetic-field generating means control section 13 controls the power to be supplied to the main heating coil 6.

The auxiliary coils 7 and 8 are respectively formed around the auxiliary cores 3 and 4 so that the polarity thereof is opposite to that of the main heating coil 6.

The auxiliary heating core 5 has almost the same length as that of the main core 2, and is supported on a support member (not shown) above the main core 2 and adjacent to the inner surface of the cylindrical fixing film 10 serving as the conductive member. The auxiliary preheating coil 9 is formed around the auxiliary heating core 5.

The auxiliary coil 7, the auxiliary preheating coil 9, and the auxiliary coil 8 constitute a series coil.

The auxiliary heating core 5, the auxiliary preheating coil 9, the auxiliary core 3, the auxiliary coil 7, the auxiliary core 4, and the auxiliary coil 8 constitute a preheating magnetic-field generating means. A preheating magnetic-field generating means control section 12 controls the power to be supplied to the series coil composed of the auxiliary coil 7, the auxiliary preheating coil 9, and the auxiliary coil 8.

Figure 4:
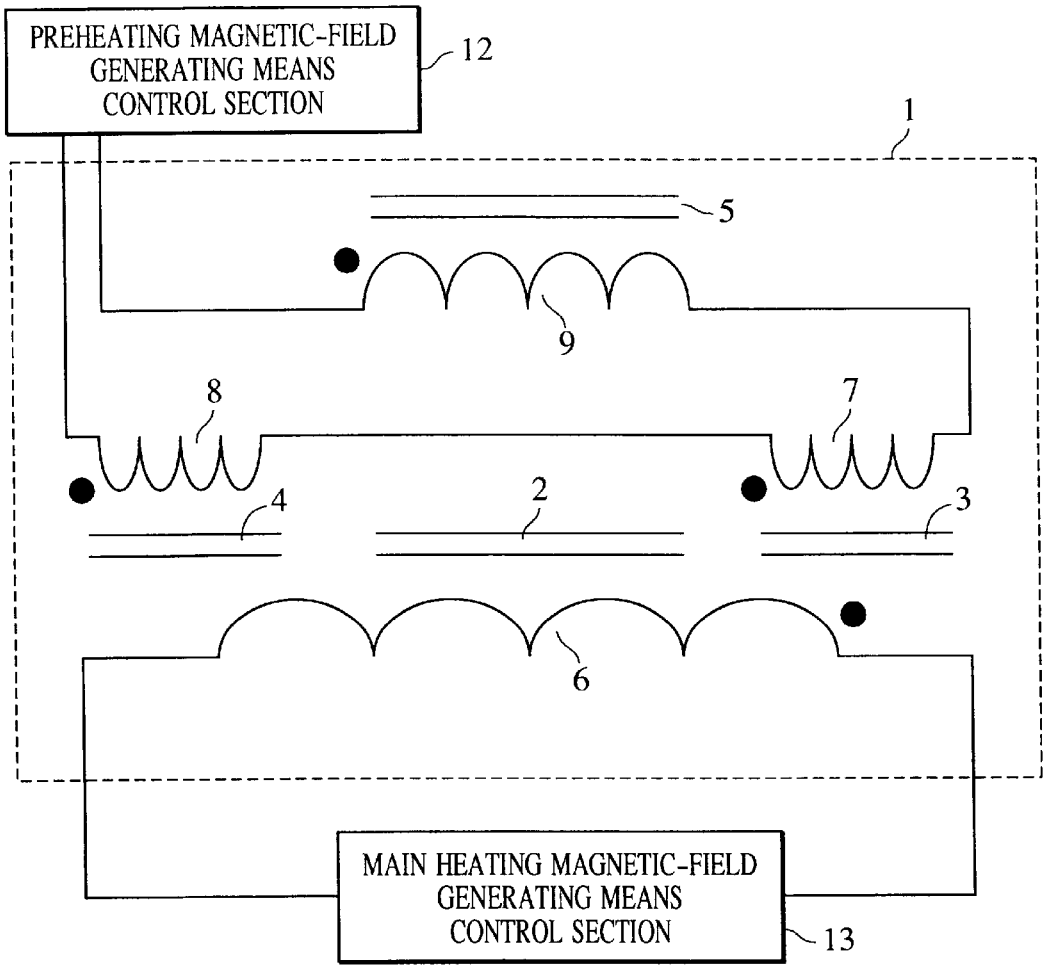
FIG. 4 is a equivalent circuit diagram of magnetic-field generating means.

FIG. 4 is an equivalent circuit diagram of the main heating magnetic-field generating means and the preheating magnetic-field generating means.

In FIG. 3, W1 represents a paper passing width (large paper passing width) at the fixing nip portion N for transfer materials having the maximum possible width (large size) to be passed through the apparatus, and W2 represents a paper passing width (small paper passing width) at the fixing nip portion N for transfer material having a smaller width. In this embodiment, transfer materials 14 are conveyed by center-reference feeding. W3 represents a paper nonpassing width at the fixing nip portion N when a small transfer material is fed passed.

The sum of the lengths of the three cores 2, 3, and 4 arranged in series substantially corresponds to the large paper feeding width W1, the length of the main core 2 substantially corresponds to the small paper feeding width W2, and the length of each of the auxiliary cores 3 and 4 corresponds to the paper nonpassing width W3 when a small transfer material is passed.

In a case in which a large transfer material 14 is passed, the control circuit exerts control so as to supply power from the main heating magnetic-field generating means control section 13 to the main heating coil 6 of the main heating magnetic-field generating means, and so as to cut off the supply of power from the preheating magnetic-field generating means control section 12 to the series coil composed of the auxiliary coil 7, the auxiliary preheating coil 9, and the auxiliary coil 8 in the preheating magnetic-field generating means.

Consequently, the conductive layer 10*b* of the fixing film 10 generates heat within the large paper feeding width W1, and the large transfer material 14 is subjected to heating and fixing. The temperature detecting element 11 detects the temperature of the fixing film 10, and feeds back information about the detected temperature to the control circuit (not shown). The control circuit causes the main heating magnetic-field generating means control section 13 to control the power to be supplied from the exciting circuit to the main heating coil 6 based on the input detected temperature information so that the temperature of the fixing nip portion N is adjusted to the predetermined fixing temperature.

In a case in which a small transfer material 14 is passed, the control circuit causes the main heating magnetic-field generating means control section 13 to supply power to the main heating coil 6 of the main heating magnetic-field generating means, and causes the preheating magnetic-field generating means control section 12 to supply power to the series coil composed of the auxiliary coil 7, the auxiliary preheating coil 9, and the auxiliary coil 8 in the preheating magnetic-field generating means.

In the preheating magnetic-field generating means to which power is supplied, since the auxiliary coils 7 and 8 having the polarity opposite to that of the main heating coil 6 are formed around the auxiliary cores 3 and 4, heat generated in the portions of the conductive layers 10*b* of the fixing film 10 corresponding to the paper nonpassing widths W3 is reduced by reducing the magnetic flux from the main heating magnetic-field generating means within the paper nonpassing widths W3. Furthermore, by regenerating the energy generated by the auxiliary coils 7 and 8 having the polarity opposite to that of the main heating coil 6 and formed around the auxiliary cores 3 and 4 as heat in a portion of the conductive layer 10*b* of the fixing film 10 corresponding to the paper-feeding width W2, the portion of the fixing film 10 corresponding to the small paper feeding width W2 is preheated. The preheating effect is increased by using an auxiliary preheating coil 9 with the same polarity as that of the main core 2.

The widths W3 in which the heat generated by electromagnetic induction by the fixing film 10 is reduced are determined based on the lengths of the auxiliary cores 3 and 4, and the preheating width W2 is determined based on the length of the preheating core 5.

In the above-described configuration, when the transfer material 14 as the material to be heated has the width W2 smaller than the maximum paper passing width W1, the auxiliary coils 7 and 8, the preheating coil 9, and the preheating core 5 connected to one another are placed separate from the cores 2, 3, and 4 inside the heating apparatus, thereby demagnetizing the magnetic flux from the main heating magnetic-field generating means and reducing heat generation within the paper nonpassing widths W3. By preheating the portion within the small paper passing width W2 for the transfer material 14 as the material to be heated, the reduced energy can be regenerated, and the energy conversion efficiency can be improved.

Furthermore, since it is unnecessary to individually control the magnetic-field generating means, the cost can be reduced, and overheating of the paper nonpassing region can be prevented with a simple means.

Second Embodiment

An induction heating apparatus according to a second embodiment of the present invention is different from the above-described induction heating apparatus of the first embodiment in that an electromagnetic shielding plate 16 is supported by a holding member (not shown) and is interposed between a magnetic-field generating means including a main heating coil 6 and a main core 2 and a magnetic-field generating means including a preheating core 5 with an auxiliary preheating coil 9 formed therearound. Since other structures of the apparatus are similar to those in the heating apparatus of the first embodiment, repetitive descriptions thereof are omitted.

In the above-described configuration, the electromagnetic shielding plate 16 can inhibit magnetic fields generated by the magnetic-field generating means from interacting with each other.

Others

In the heating apparatuses 106 of the first and second embodiments, the fixing film 10 may be made of a heat-resistant film having no electromagnetic induction heating property, instead of the film including the conductive layer 10*b*, and an electromagnetic shielding plate 16 fixed to the stay member 17 may be made of a material having an electromagnetic induction heating property, such as an iron plate, which is caused to generate heat by electromagnetic induction from a magnetic field of the magnetic-field generating means and to heat the transfer material 14 via the fixing film 10.

Alternatively, a material to be heated may be directly heated by an electromagnetic induction heating member which is fixed or is movable with no film or the like therebetween. The heating apparatus of the present invention is not limited to the image heating-fixing apparatus as shown in the embodiments, but is widely applicable to, for example, an image heating apparatus for heating a recording material having an image thereon so as to improve the surface characteristic, such as luster, of the recording material, an image heating apparatus for heating a recording material having an image thereon so as to temporarily fix the image, and a heating apparatus for supplying a sheet like material and subjecting the material to drying, smoothing, or laminating.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An induction heating apparatus for heating an image formed on a recording material, said induction heating apparatus comprising:

a heating member;

a first coil for generating a magnetic field to induce an eddy current in said heating member;

a second coil for cancelling the magnetic field generated by said first coil; and a third coil connected to said second coil and wound in a direction opposite from the winding direction of said second coil.

2. An induction heating apparatus according to claim 1, further comprising a first core and a second core, wherein said first coil is formed around said first and second cores, and said second coil is formed around said second core.

3. An induction heating apparatus according to claim 2, further comprising a third core, wherein said third coil is formed around said third core.

4. An induction heating apparatus according to claim 2, wherein said first core and said second core are arranged in a direction intersecting the moving direction of the recording material, the sum of the lengths of said first core and said second core corresponds to the width of a first fixed-sized recording material, and the length of said first core corresponds to the width of a fixed-sized recording material smaller than the first fixed-sized recording material.

5. An induction heating apparatus according to claim 1, wherein said third coil serves to increase the strength of the magnetic field generated by said first coil.

6. An induction heating apparatus according to claim 1, wherein an electromagnetic shielding plate is interposed between said first coil and said third coil.

* * * * *

UNITED STATES PATENT AND TRADEMARK OFFICE

CERTIFICATE OF CORRECTION

PATENT NO. : 6,373,036 B2
DATED : April 16, 2002
INVENTOR(S) : Hitoshi Suzuki

It is certified that error appears in the above-identified patent and that said Letters Patent is hereby corrected as shown below:

Column 1,
Line 20, “fixedaas” should read -- fixed as --.

Column 42,
Line 42, “mediums-sized” should read -- medium-sized --.

Signed and Sealed this

Eleventh Day of June, 2002

*Attest:*

*Attesting Officer*

JAMES E. ROGAN
*Director of the United States Patent and Trademark Office*